US010485398B2

(12) United States Patent
Woo et al.

(10) Patent No.: US 10,485,398 B2
(45) **Date of Patent: *Nov. 26, 2019**

(54) DISHWASHER

(71) Applicant: LG ELECTRONICS INC., Seoul (KR)

(72) Inventors: Seyoung Woo, Seoul (KR); Joonho Pyo, Seoul (KR)

(73) Assignee: LG ELECTRONICS, Seoul (KR)

( * ) Notice: Subject to any disclaimer, the term of this patent is extended or adjusted under 35 U.S.C. 154(b) by 448 days.

This patent is subject to a terminal disclaimer.

(21) Appl. No.: 14/736,845

(22) Filed: Jun. 11, 2015

(65) Prior Publication Data

US 2015/0359409 A1 Dec. 17, 2015

(30) Foreign Application Priority Data

Jun. 12, 2014 (KR) ..... 10-2014-0071651

(51) Int. Cl.
*A47L 15/42* (2006.01)
*A47L 15/23* (2006.01)

(52) U.S. Cl.
CPC ..... *A47L 15/428* (2013.01); *A47L 15/23* (2013.01); *A47L 15/4221* (2013.01)

(58) Field of Classification Search
CPC .... A47L 15/428; A47L 15/23; A47L 15/4221; A47L 15/4223; A47L 15/4282
See application file for complete search history.

(56) References Cited

U.S. PATENT DOCUMENTS 3,841,342 A * 10/1974 Cushing ..... A47L 15/23 134/144
5,427,129 A * 6/1995 Young, Jr. ..... A47L 15/23 134/176

(Continued)

FOREIGN PATENT DOCUMENTS

CN 2503839 Y 8/2002
CN 101161184 4/2008

(Continued)

OTHER PUBLICATIONS

European Search Report dated Oct. 16, 2015 issued in Application No. 15171633.9.

(Continued)

*Primary Examiner* — Michael E Barr
*Assistant Examiner* — Tinsae B Ayalew
(74) *Attorney, Agent, or Firm* — KED & Associates, LLP

(57) ABSTRACT

A dishwasher includes a tub to provide a wash space, a first rack located inside the tub to receive a washing object and a second rack located below the first rack, a flow path tower provided at the second rack to eject wash water to the first rack, an ejection arm including a chamber for introduction of wash water, a first flow path in communication with the chamber, and second and third flow paths in communication with the chamber to eject wash water to the second rack and separated from each other, a tower separable coupler provided inside the ejection arm to connect the first flow path to the flow path tower when wash water is supplied to the first flow path, and a flow path switcher provided inside the chamber to selectively open the first, second and third flow paths according to a pressure inside the chamber.

19 Claims, 13 Drawing Sheets

(56) References Cited

U.S. PATENT DOCUMENTS

| | | | | |
|---|---|---|---|---|
| 9,700,194 | B2 * | 7/2017 | Han | A47L 15/508 |
| 2012/0285495 | A1 | 11/2012 | Pyo et al. | |

FOREIGN PATENT DOCUMENTS

| | | | |
|---|---|---|---|
| CN | 102858221 | | 1/2013 |
| CN | 103371789 | | 10/2013 |
| EP | 2 522 268 | A1 | 11/2012 |
| WO | WO 2011-132356 | A1 | 10/2011 |
| WO | WO 2011-132358 | A1 | 10/2011 |

OTHER PUBLICATIONS

Chinese Office Action dated Jun. 30, 2017 issued in Application No. 201510319432.3 (with English translation).

* cited by examiner (a)

(b)

(a)

(b)

(a)

(b)

(a)

(b)

(a)

(b)

DISHWASHER

CROSS-REFERENCE TO RELATED APPLICATION

This application claims priority under 35 U.S.C. § 119 to Korean Application No. 10-2014-0071651 filed on Jun. 12, 2014, whose entire disclosure is hereby incorporated by reference.

BACKGROUND

1. Field

The present disclosure relates to a dishwasher and a control method thereof.

2. Background

A dishwasher is a device that washes contaminants, such as leftover food, attached to dishes, cooking utensils or the like (hereinafter referred to as "washing object") using a detergent and wash water. A general dishwasher includes a tub providing a wash space, a dish rack placed in the tub to receive a washing object therein, an ejection arm to eject wash water to the rack, a sump to store wash water therein, and a supply flow path to supply the wash water stored in the sump to the ejection arm.

The dishwasher having the above-described configuration may remove contaminants from the washing object by ejecting wash water to the washing object received in the rack according to a wash course selected by a user. The washed object, from which the contaminants have been removed, may be dried by hot air or heater.

BRIEF DESCRIPTION OF THE DRAWINGS

The embodiments will be described in detail with reference to the following drawings in which like reference numerals refer to like elements wherein.

DETAILED DESCRIPTION

Figure 1:
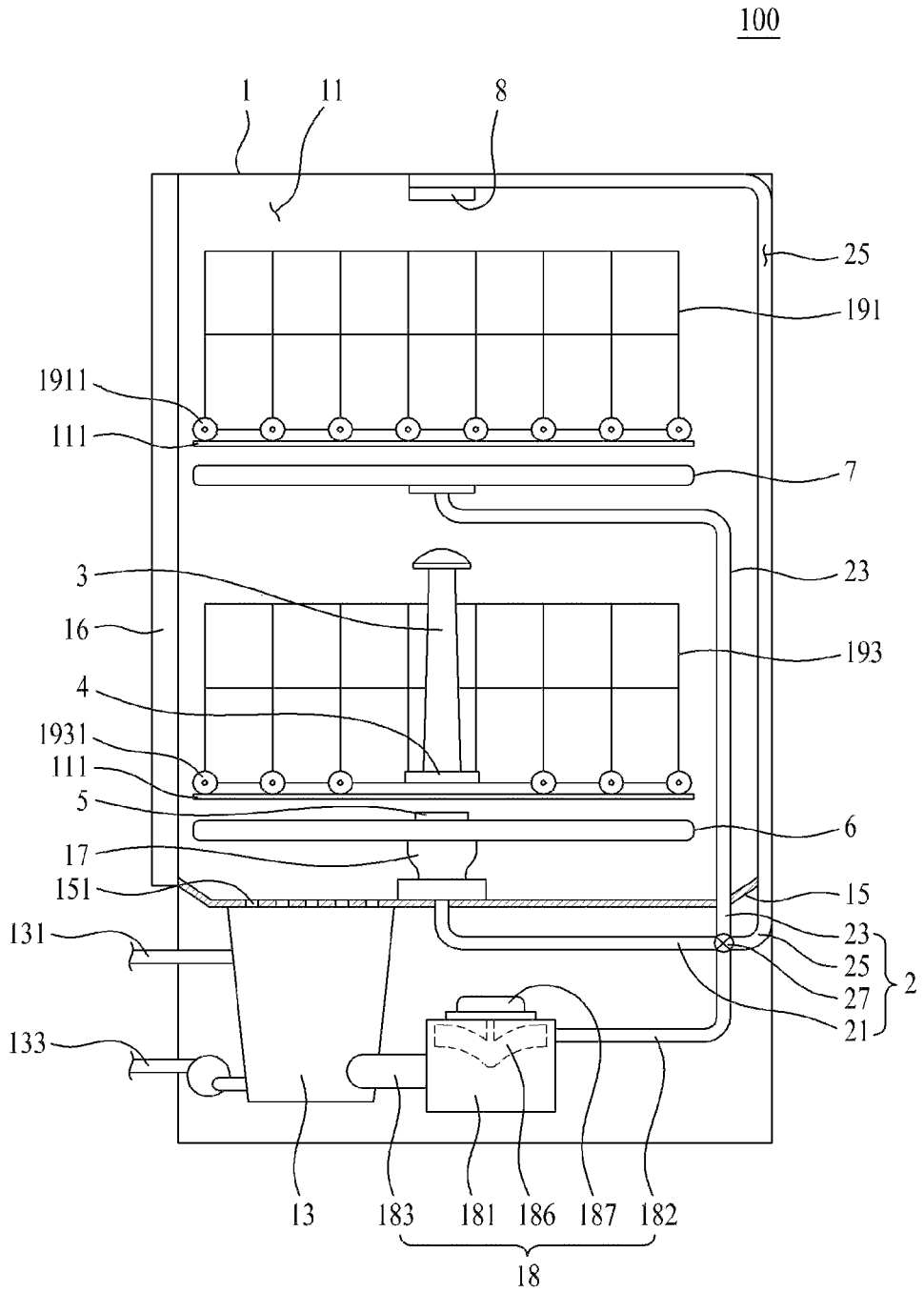
FIG. 1 is a view illustrating a dishwasher according to the present disclosure.

FIG. 1 illustrates a configuration of a dishwasher according to the present disclosure. The dishwasher of the present disclosure, designated by reference numeral 100, includes a cabinet 1 defining an external appearance of the dishwasher 100, a tub 11 located inside the cabinet 1 to provide a wash space, a sump 13 located below the tub 11 to store wash water therein (i.e. a means to recover wash water inside the tub 11), a cover 15 located at the top of the sump 13 to separate the tub 11 and the sump 13 from each other, and a door 16 coupled to the cabinet 1 to open or close the wash space.

The sump 13 receives wash water through a sump water supply flow path 131 and the wash water inside the sump 13 is discharged from the sump 13 through a sump water drain flow path 133. As such, wash water, ejected into the tub 11 through ejection arms 6, 7 and 8 that will be described below, is recovered to the sump 13 through recovery holes 151 formed in the cover 15.

At least one rack is placed in the tub 11 and a washing object such as a dish is received in the rack. The rack may include a first rack 191 and a second rack 193 located below the first rack 191. For convenience, the first rack 191 is called an upper rack and the second rack 193 is called a lower rack.

The upper rack 191 and the lower rack 193 may be installed to be retractable from the tub 11 when the door 16 opens the wash space. To this end, rails 111 are installed to the inner circumferential surface of the tub 11 to extend from the rear surface of the dishwasher 100 to the front surface at which the door 16 is provided. The upper rack 191 and the lower rack 193 may be provided with wheels 1911 and 1931 to allow the respective racks 191 and 193 to be supported by the rails 111.

Meanwhile, the ejection arms according to the present disclosure may include a lower arm 6 installed in the tub 11 to wash a washing object received in the lower rack 193, an upper arm 7 to wash a washing object received in the upper rack 191, and a top nozzle 8 located above the upper arm 7 to supply wash water to the upper rack 191 and the lower rack 193.

The lower arm 6, the upper arm 7, and the top nozzle 8 may be adapted to supply wash water through a water supply pump 18 and a supply flow path 2. The supply flow path 2 may include a first supply flow path 21 connected to the lower arm 6 through an arm holder 17, a second supply flow path 23 connected to the upper arm 7, a third supply flow path 25 connected to the top nozzle 8, and a supply flow path switching valve 27 to selectively open the respective supply flow paths 21, 23 and 25.

The water supply pump 18 may include a housing 181 equipped with an impeller 186 therein, an inlet pipe 183 to connect the housing 181 and the sump 13 to each other, an outlet pipe 182 to connect the housing 181 and the supply flow path switching valve 27 to each other, and a motor 187 installed to the exterior of the housing 181 to rotate the impeller 186.

With the above-described configuration, when the impeller 186 is rotated as power is supplied to the motor 187, water suctioned from the sump 13 into the housing 181 moves to the supply flow path switching valve 27 through the outlet pipe 182 and, in turn, the water directed to the supply flow path switching valve 27 is supplied to the ejection arms 6 and 7 or the top nozzle 8 along the supply flow paths 21, 23 and 25 that are opened respectively by the supply flow path switching valve 27.

The supply flow path switching valve 27 may be adapted to sequentially open the respective supply flow paths 21, 23 and 25 and may also be adapted to open at least two among the aforementioned three supply flow paths 21, 23 and 25. Note that the supply flow path switching valve 27 may have any configuration so long as it can implement the above-described function.

Meanwhile, in the present disclosure, note that the upper arm 7 and the top nozzle 8 as described above may be omitted because the washing object received in the lower rack 193 may be washed through use of a second flow path (F2, see FIGS. 3A and 3B) and a third flow path (F3, see FIGS. 3A and 3B) formed in the lower arm 6 and the washing object received in the upper rack 191 may be washed through use of a flow path tower 3 that will be described below. When the upper arm and the top nozzle are not installed in the tub, the dishwasher 100 of the present disclosure may attain a minimum height.

The dishwasher 100 of the present disclosure may further include the flow path tower 3 separably coupled to the lower rack 193 to extend toward the upper rack 191, and a tower separable coupler 5 configured to be retractable from the lower arm 6 according to a water pressure inside the lower arm 6 to thereby be connected to the flow path tower 3 (in order to supply wash water to the flow path tower 3).

Figure 2:
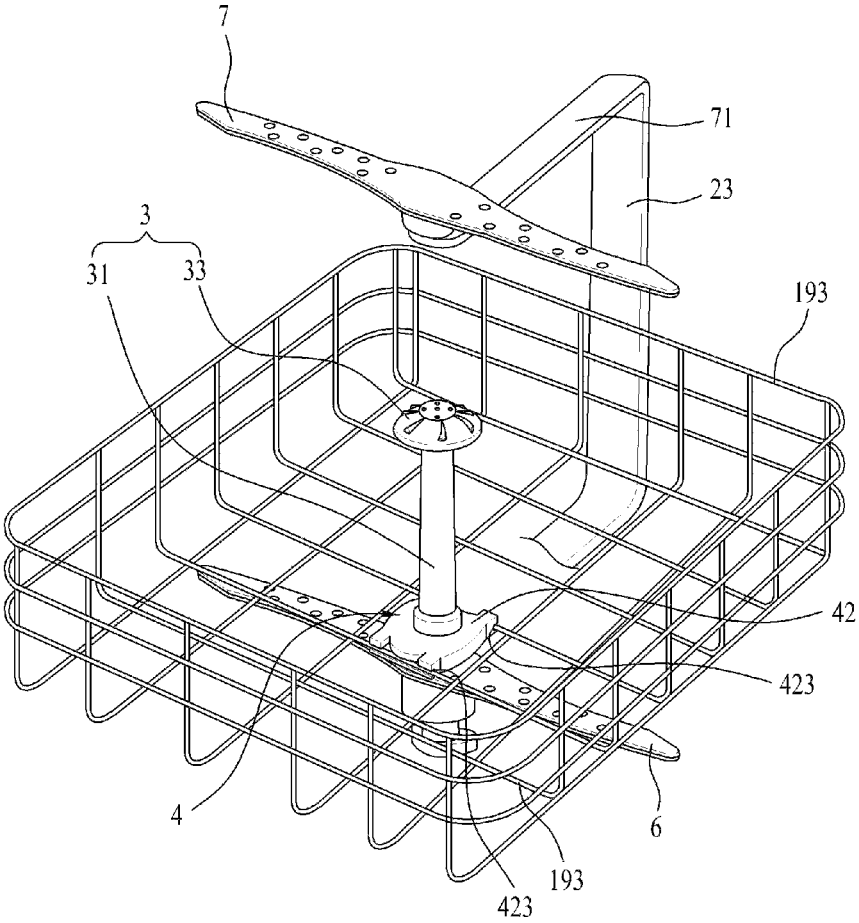
FIG. 2 is a view illustrating an upper arm, a lower arm, and a flow path tower included in the dishwasher according to the present disclosure.
Figure 3A:
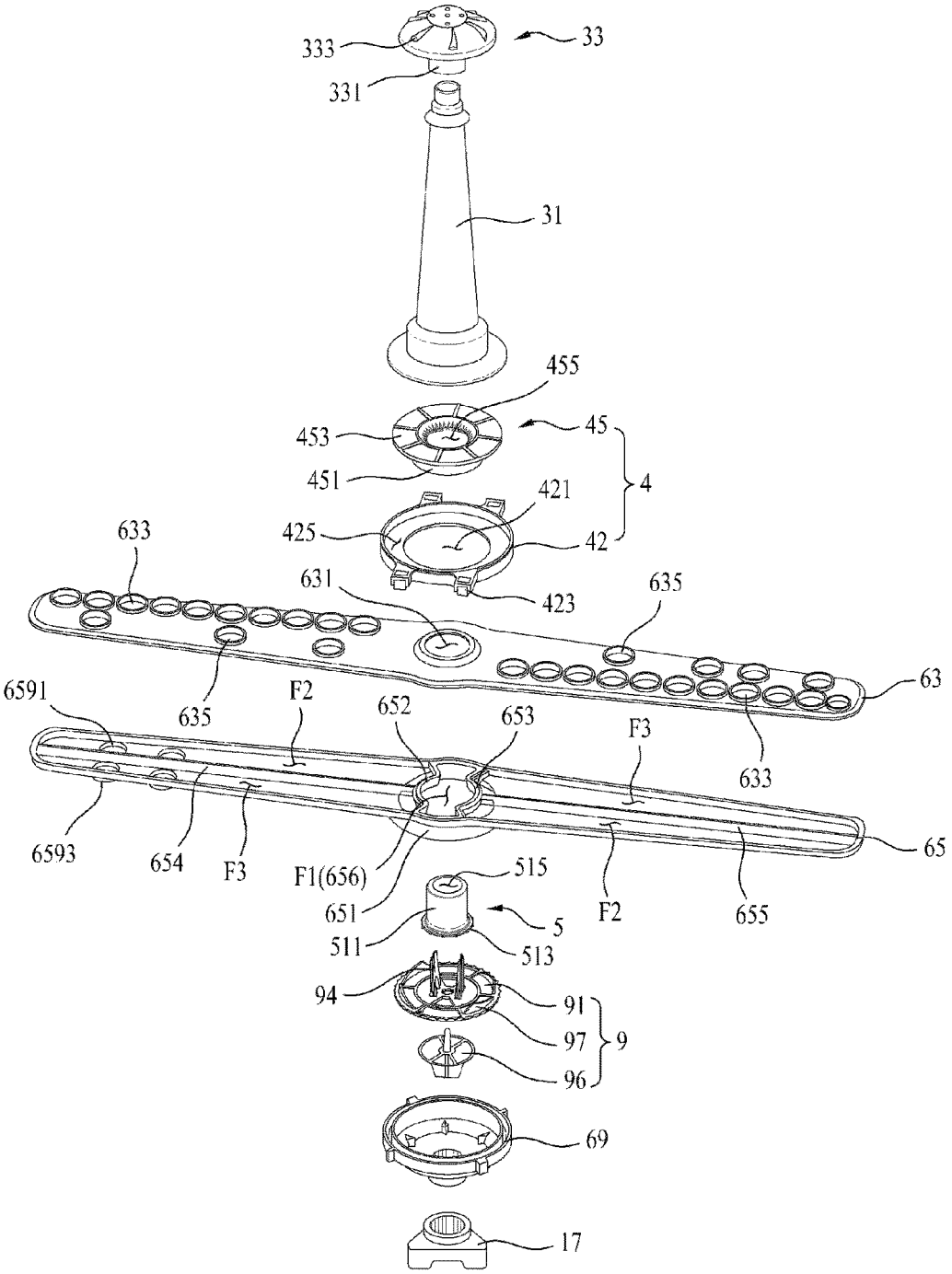
FIGS. 3A and 3B are respectively an exploded perspective view and a sectional view illustrating the flow path tower and the lower arm.
Figure 3B:
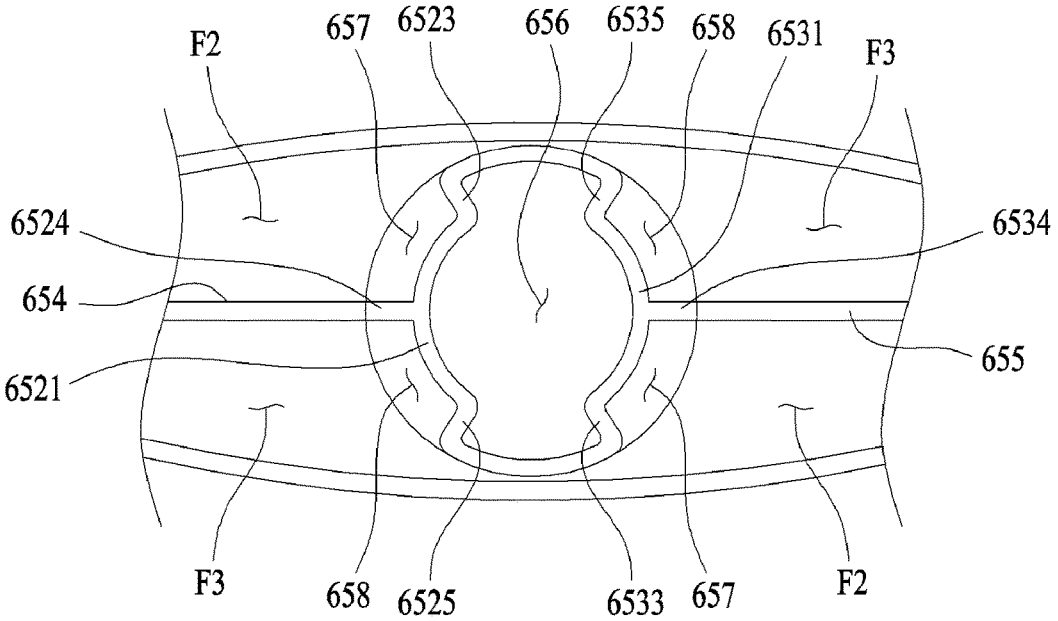

As exemplarily illustrated in FIG. 2 and FIGS. 3A and 3B, the flow path tower 3 is fixed to a tower support unit 4 and, in turn, the tower support unit 4 is separably fixed to the lower rack 193. That is, the flow path tower 3 may be coupled to or separated from the lower rack 193 via the tower support unit 4.

The flow path tower 3 may include a body 31 fixed to the tower support unit 4, and an ejection nozzle 33 to eject wash water supplied through the body 31 to the upper rack 191. The body 31 may take the form of a cylinder having open upper and lower ends. The ejection nozzle 33 is coupled to the upper end of the body 31 and the tower support unit 4 is coupled to the lower end of the body 31.

The body 31 may be reduced in the diameter of a cross section with increasing distance from the lower end thereof. This serves to allow wash water introduced through the lower end of the body 31 to move toward the ejection nozzle 33 while maintaining a constant water pressure.

As exemplarily illustrated in FIG. 3A, the ejection nozzle 33 may include a connection pipe 331 coupled to the upper end of the body 31, and a plurality of ejection holes 333 through which the wash water, introduced into the ejection nozzle 33 through the connection pipe 331, is discharged from the ejection nozzle 33.

The connection pipe 331 serves to couple the ejection nozzle 33 to the body 31 to enable rotation of the ejection nozzle 33. The ejection holes 333 allow the ejection nozzle 33 to be rotated by repulsive force of water discharged from the ejection nozzle 33. The ejection holes 333 are arranged in a spiral shape at an upper surface of the ejection nozzle 33 to allow the ejection nozzle 33 to be rotated in the clockwise direction or in the counterclockwise direction upon ejection of wash water.

The tower support unit 4 may include a fixing body 42 to which the body 31 of the flow path tower 3 is fixed and a connector 45 coupled to the fixing body 42 such that the tower separable coupler 5 retracted from the lower arm 6 is connected to the connector 45.

As exemplarily illustrated in FIG. 3A, the fixing body 42 may have a fixing body through-hole 421 and rack coupling pieces 423. Note that the fixing body through-hole 421 is sufficient so long as it is formed through the fixing body 42 and the rack coupling pieces 423 may have any shape so long as they can separably couple the fixing body 42 to the lower rack 193.

Figure 4:
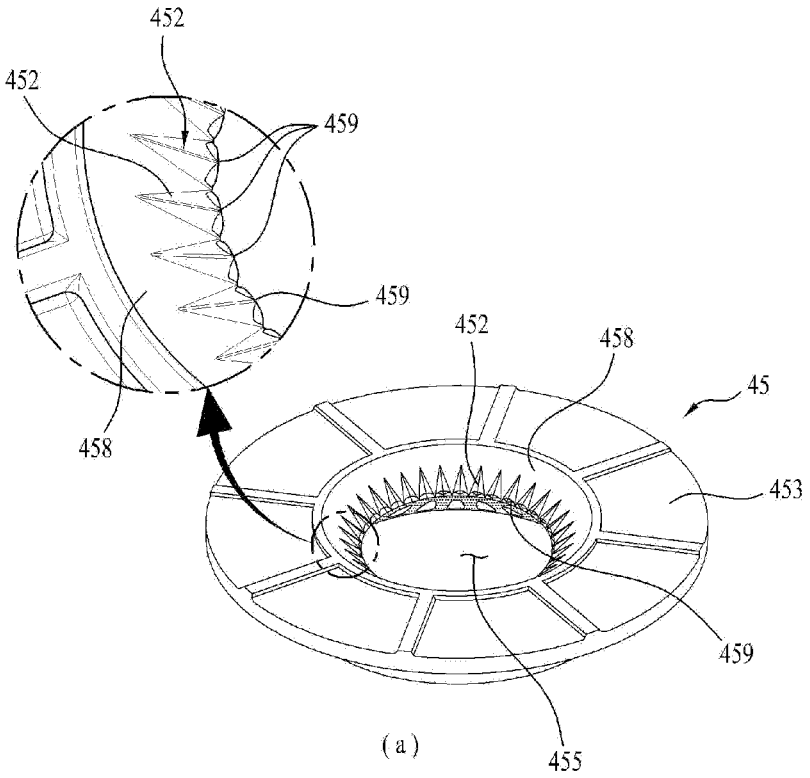
FIG. 4 is a view illustrating a connector included in a tower support unit.
Figure 4:
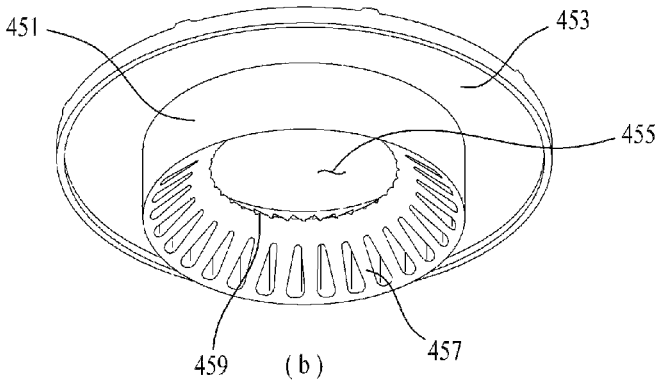

As exemplarily illustrated in FIG. 4, the connector 45 includes a cylindrical connector body 451 configured to be inserted into the fixing body through-hole 421, a receiving hole 455 formed through the connector body 451 so as to be in communication with the body 31 of the flow path tower 3, and a connector flange 453 protruding from the outer circumferential surface of the connector body 451.

The connector flange 453 is supported by a flange seat (425, see FIG. 3A) that protrudes from the inner circumference of the fixing body through-hole 421 toward the center of the fixing body through-hole 421. The diameter of the connector body 451 is smaller than the diameter of the fixing body through-hole 421. The diameter of the connector flange 453 is greater than the diameter of the fixing body through-hole 421 and smaller than the diameter of the flange seat 425.

With the above-described configuration, the connector flange 453 is seated on the flange seat 425 to prevent the connector body 451 from being separated from the fixing body 42 through the fixing body through-hole 421 while allowing the connector body 451 to be movable in the fixing body through-hole 421. Since the connector body 451 is radially movable in the fixing body through-hole 421, easy insertion of the tower separable coupler 5 into the receiving hole 455 may be facilitated in the case where the center of a coupler body (511, see FIG. 3A) and the center of the receiving hole 455 do not coincide with each other due to a position of the lower rack 193 or in the case where the lower rack 6 is rotated without remaining in a horizontal state.

To more easily achieve the above-described effect, the connector body 451 may have a lower slope 457 formed at a lower end of the receiving hole 455 to guide the tower separable coupler 5 to the center of the receiving hole 455. The receiving hole 455 may be formed with receiving hole bosses 459 protruding to the center of the receiving hole 455.

The receiving hole bosses 459 serve to facilitate coupling of the tower separable coupler 5 into the receiving hole 455 or separation of the tower separable coupler 5 from the receiving hole 455 by minimizing a contact area between the tower separable coupler 5 and the receiving hole 455. A free end of each receiving hole boss 459 may have a curved surface.

When the free end of the receiving hole boss 459 has a curved surface, it is possible to reduce the cross sectional area of a space defined between the receiving hole 455 and the outer circumferential surface of the tower separable coupler 5 as compared to the case where the free end of the receiving hole boss 459 has a pointed shape. This may minimize leakage of wash water through the space between the receiving hole 455 and the tower separable coupler 5 and maximally prevent impurities from jamming in the space between the receiving hole 455 and the tower separable coupler 5.

The receiving hole bosses 459, e.g., the apex of the curved surface, may be spaced apart from one another by a predetermined distance along the circumference of the receiving hole 455. The connector body 451 may further have an upper slope 458 formed at an upper surface thereof so as to be inclined toward the receiving hole 455, and slope ridges 452 protruding from the upper slope to guide wash water to spaces between a respective one of the receiving hole bosses 459 and a neighboring one of the receiving hole bosses 459.

Moving wash water to the spaces between a respective one of the receiving hole bosses 459 and a neighboring one of the receiving hole bosses 459 serves to prevent impurities contained in the wash water from jamming between the receiving hole 455 and the outer circumferential surface of the tower separable coupler 5.

Figure 5:
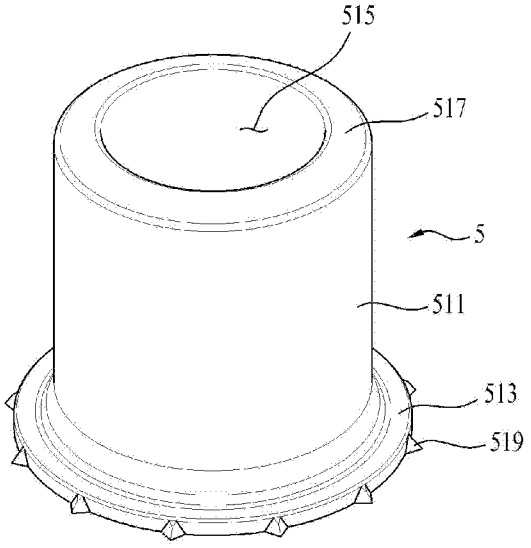
FIG. 5 is a view illustrating a tower separable coupler.
Figure 5:
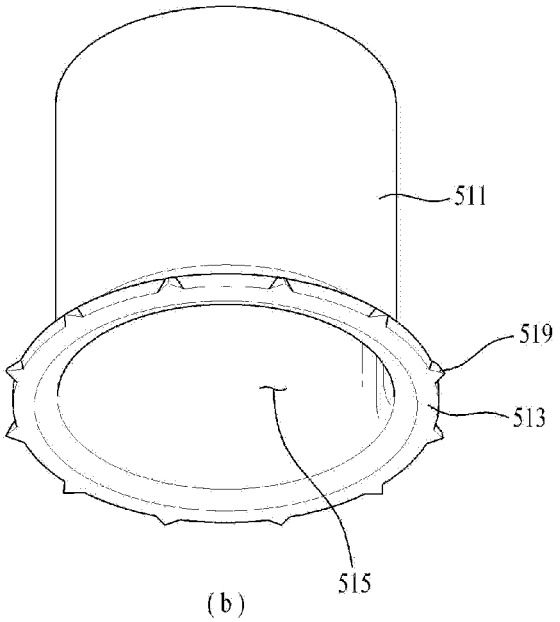

As exemplarily illustrated in FIG. 5, the tower separable coupler 5, which is retractable from the lower arm 6 to supply wash water to the flow path tower 3, may include a separable coupling body 511 coupled to the lower arm 6. The separable coupler body 511 is retracted from the lower arm 6 according to a pressure (water pressure) inside a chamber 69, which is defined in the lower arm 6 as will be described below. Then, the separable coupler body 511 is inserted into the receiving hole 455 of the tower support unit 4. Once the separable coupler body 511 has been inserted into the receiving hole 455, wash water is supplied to the flow path tower 3. A detailed description thereof will follow.

The separable coupler body 511 may take the form of a cylinder having open upper and lower ends. The separable coupler body 511 has a body through-bore 515 formed through the center thereof to extend in the height direction of the separable coupler body 511, and a separable coupler flange 513 protruding from the outer circumferential surface of the separable coupler body 511.

The separable coupler flange 513 serves to prevent the separable coupler body 511 from being separated from the lower arm 6. The diameter of the outer circumferential surface of the separable coupler flange 513 is larger than the diameter of a first discharge hole (631, see FIG. 6) formed in the lower arm 6.

The separable coupler flange 513 may be provided at the outer circumferential surface thereof with flange bosses 519 and the separable coupler body 511 may be provided at the upper end thereof with a guide support portion 517 protruding toward the center of the body through-bore 515. Functions of the flange bosses 519 and the guide support portion 517 will be described below.

As exemplarily illustrated in FIG. 3A, the lower arm 6 according to the present disclosure may include the chamber 69 rotatably coupled to the arm holder 17, a lower frame 65 having arm flow paths F1, F2 and F3 that are in communication with the chamber 69, and an upper frame 63 having discharge holes 631, 633 and 635 to discharge wash water introduced into the arm flow paths F1, F2 and F3 from the lower arm 6 (toward the lower rack 193).

The lower frame 65 includes a chamber communication hole 651 for connection of the chamber 69, and partitions 652, 653, 654 and 655 to divide an inner space of the lower frame 65 so as to define the arm flow paths F1, F2 and F3. The arm flow paths defined in the lower arm 6 may include a first flow path F1, a second flow path F2, and a third flow path F3. The first flow path F1 is defined by a first partition 652 and a second partition 653, and the second flow path F2 and the third flow path F3 are defined by a third partition 654 and a fourth partition 655.

The first partition 652 and the second partition 653 are configured to divide the chamber communication hole 651 into three regions. As exemplarily illustrated in FIG. 3B, the first partition 652 may be constituted by a first flange 6521 located inside the chamber communication hole 651, and a first rib 6523, a second rib 6524, and a third rib 6525 which fix the first flange 6521 to the lower frame 65. The second partition 653 may include a second flange 6531 located inside the chamber communication hole 651 to face the first flange 6521, and a fourth rib 6533, a fifth rib 6534, and a third rib 6535 which fix the second flange 6531 to the lower frame 65.

The first flange 6521 and the second flange 6531 must be configured to permit passage of the separable coupler flange 513. FIG. 3B illustrates the case where the first flange 6521 and the second flange 6531 have the same radius of curvature by way of example. A distance between the first flange 6521 and the second flange 6531 is greater than the diameter of the outer circumferential surface of the separable coupler flange 513.

The first rib 6523 and the third rib 6525 serve to fix both ends of the first flange 6521 to the lower frame 65, and the second rib 6524 protrudes from the first flange 6521 to bisect a space between the first rib 6523 and the third rib 6525. When the chamber communication hole 651 defined between the first rib 6523 and the third rib 6525 is divided into two spaces by the second rib 6524, one space serves as a second communication hole 657 to communicate the second flow path F2 and the chamber 69 with each other and the other space serves as a third communication hole 658 to communicate the third flow path F3 and the chamber 69 with each other.

The fourth rib 6533 and the sixth rib 6535 serve to fix both ends of the second flange 6531 to the lower frame 65, and the fifth rib 6534 protrudes from the second flange 6531 to bisect a space between the fourth rib 6533 and the sixth rib 6535. When the chamber communication hole 651 defined between the fourth rib 6533 and the sixth rib 6535 is divided into two spaces by the fifth rib 6534, one space serves as the second communication hole 657 to communicate the second flow path F2 and the chamber 69 with each other and the other space serves as the third communication hole 658 to communicate the third flow path F3 and the chamber 69 with each other.

The sixth ribs 6523, 6524, 6525, 6533, 6534 and 6535 as described above may be spaced apart from one another by the same angle (60 degrees) on the basis of the center of the chamber communication hole 651. This is because the above-described six ribs serve as means (upper gear coupling pieces) that are coupled to upper gears 97 included in a flow path switcher 9 so as to rotate a switcher body 91.

The third partition 654 extends from the second rib 6524 and protrudes from the lower frame 65 to divide the inner space of the lower frame 65. The fourth partition 655 extends from the fifth rib 6534 and protrudes from the lower frame 65 to divide the inner space of the lower frame 65.

As exemplarily illustrated in FIG. 3A, the lower frame 65 may have lower ejection holes for ejection of wash water toward the cover 15. The lower ejection holes may include first lower ejection holes 6591, through which wash water introduced into the second flow path F2 is ejected to the cover 15, and second lower ejection holes 6593 through which wash water introduced into the third flow path F3 is ejected to the cover 15. This serves to prevent the recovery holes 151 from being clogged by impurities through use of wash water discharged through the respective lower ejection holes.

The upper frame 63 has a first discharge hole 631 located above a first communication hole 656, second discharge holes 633 through which wash water introduced into the second flow path F2 is discharged from the lower arm 6, and third discharge holes 635 through which wash water introduced into the third flow path F3 is discharged from the lower arm 6. The first discharge hole 631, which is located above the first communication hole 656, must have a smaller diameter than the diameter of the first communication hole 656.

FIG. 3A illustrates the case where the first discharge hole 631 is located above a space defined by the first flange 6521 and the second flange 6531. In the illustrated case, the diameter of the first discharge hole 631 is larger than the diameter of the outer circumferential surface of the separable coupler body 511 and smaller than the diameter of the outer circumferential surface of the separable coupler flange 513.

Figure 6:
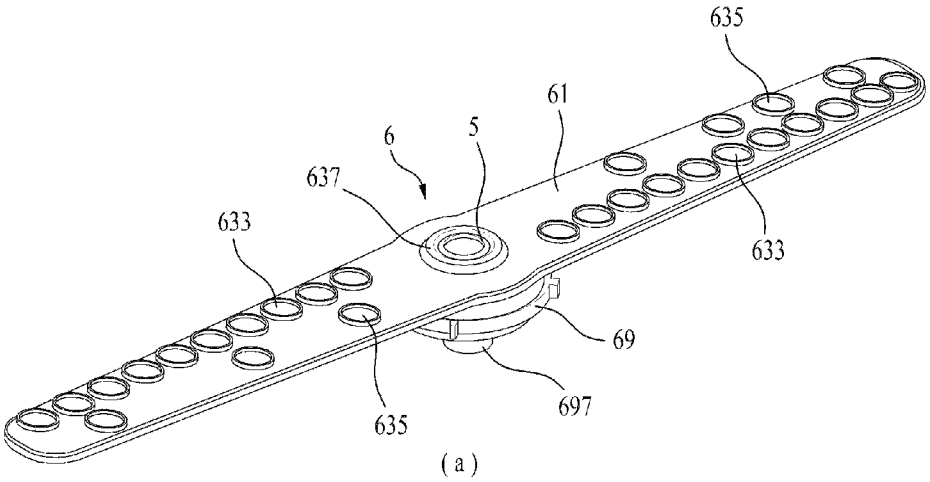
FIGS. 6 and 7 are views illustrating the lower arm and a chamber.
Figure 6:
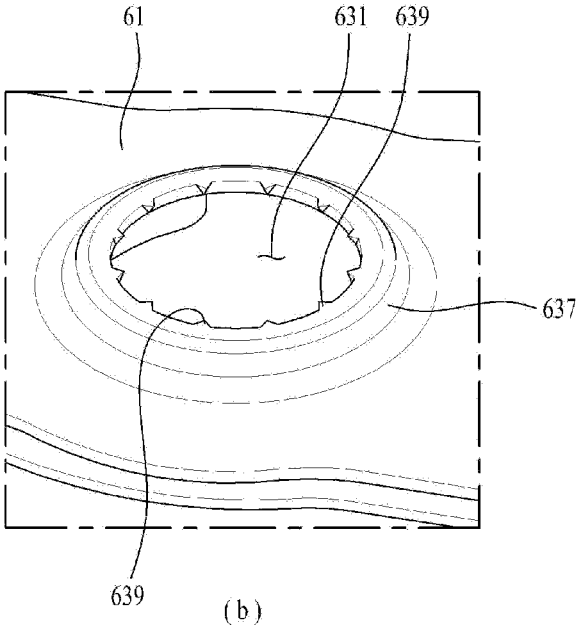

As exemplarily illustrated in FIG. 6, the first discharge hole 631 is defined by a flange receiving portion 637 that protrudes from the upper frame 63. The first discharge hole 631 serves to provide a space to allow the separable coupler body 511 of the tower separable coupler 5 to be retracted from the lower arm 6.

The diameter of the inner circumferential surface of the flange receiving portion 637 must be greater than the diameter of the outer circumferential surface of the separable coupler flange 513. The flange bosses 519 formed at the separable coupler flange 513 serve to minimize a contact area between the outer circumferential surface of the separable coupler flange 513 and the inner circumferential surface of the flange receiving portion 637. As such, the flange bosses 519 facilitate easy separation of the separable coupler flange 513 from the flange receiving portion 637.

Differently from the illustration of the drawings, the flange bosses 519 may be configured to protrude from the flange receiving portion 637 toward the separable coupler body 511. In addition, in order to facilitate easy coupling of the separable coupler body 511 into the first discharge hole 631 as well as easy separation of the separable coupler body 511 from the first discharge hole 631, the first discharge hole 631 may have discharge hole bosses 639 protruding from the circumference thereof toward the center of the first discharge hole 631.

The second discharge holes 633 and the third discharge holes 635 may be configured to allow the lower arm 6 to be rotated about the arm holder 17 by repulsive force of wash water discharged from the respective discharge holes 633 and 635. In this case, each second discharge hole 633 may require a first nozzle (not illustrated) to obliquely eject wash water supplied to the second discharge hole 633 by a predetermined angle with respect to a plane parallel to a surface of the upper frame 63. Each third discharge hole 635 may require a second nozzle (not illustrated) to obliquely eject wash water supplied to the third discharge hole 635 by a predetermined angle with respect to a plane parallel to the surface of the upper frame 63.

The ejection direction of wash water discharged from the first nozzle and the ejection direction of wash water discharged from the second nozzle may be opposite to each other. This serves to increase washing efficiency by differing the rotation direction of the lower arm 6 when wash water is discharged from the second discharge hole 633 from the rotation direction of the lower arm 6 when wash water is discharged from the third discharge hole 635.

In addition, the ejection flow rate of wash water supplied to the washing object through the first flow path F1, the ejection flow rate of wash water supplied to the washing object through the second flow path F2, and the ejection flow rate of wash water supplied to the washing object through the third flow path F3 may differ from one another.

FIG. 6 illustrates the case where the number of the second discharge holes 633 and the number of the third discharge holes 635 differ from each other such that the ejection flow rate of wash water supplied to the washing object through the second flow path F2 is less than the ejection flow rate of wash water supplied to the washing object through the third flow path F3.

In this case, the ejection flow rate of the flow path tower 3 that ejects wash water supplied through the first flow path F1 may be equal to any one of ejection flow rates of the second discharge hole 633 or the third discharge hole 635, or may be different from the ejection flow rate of the second discharge hole 633 and the ejection flow rate of the third discharge hole 635.

Figure 7:
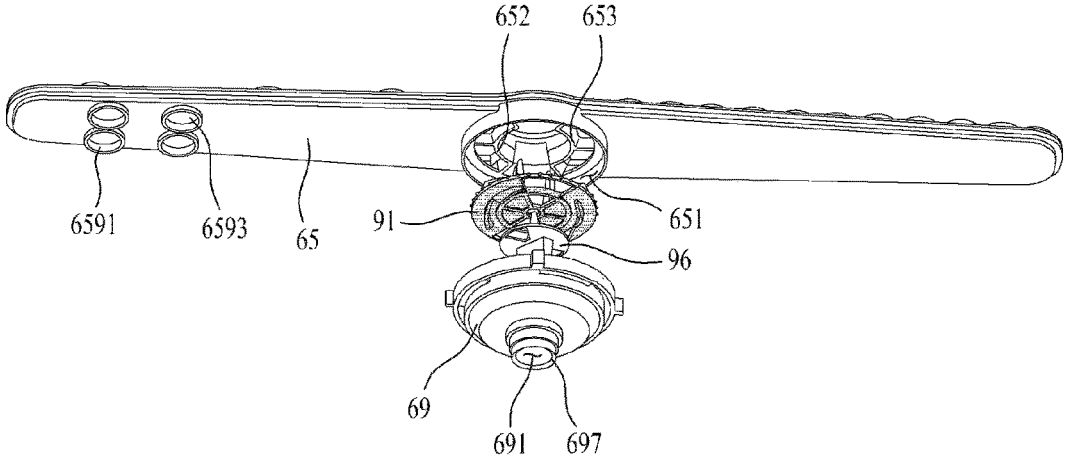
Figure 7:
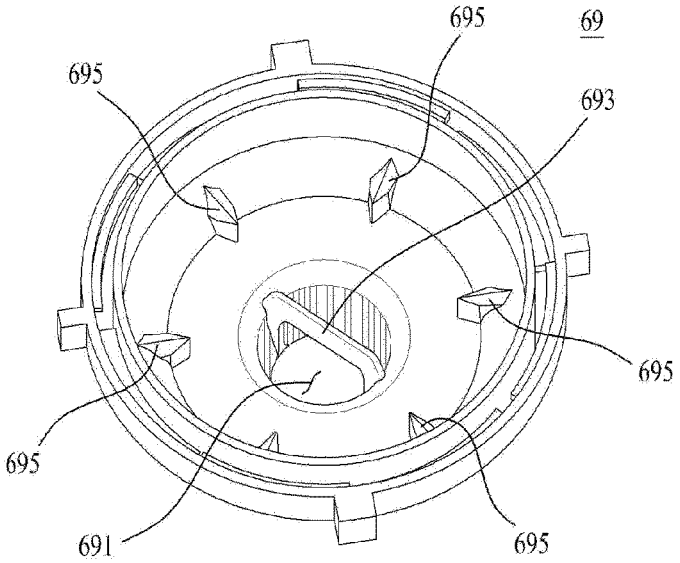

As exemplarily illustrated in FIG. 7, the chamber 69 is fixed to the chamber communication hole 651 formed in the lower frame 65. The chamber 69 is coupled to the lower frame 65 such that the first communication hole 656, the second communication holes 657 and the third communication holes 658 are located inside the chamber 69. That is, the chamber 69 is coupled to enclose the first communication hole 656, the second communication holes 657 and the third communication holes 658.

The chamber 69 includes a support pipe 697 rotatably coupled to the arm holder 17, an inlet hole 691 formed through the support pipe 697 to permit introduction of wash water into the chamber 69, and lower gear coupling pieces 695 formed at the inner circumferential surface of the chamber 69. The lower gear coupling pieces 695 are adapted to be engaged with lower gears 99 of the flow path switcher 9 that will be described below in FIG. 9, thereby serving to rotate the switcher body 91 by a constant angle.

The lower gear coupling pieces 695 are spaced apart from one another by the same angle along the inner circumference of the chamber 69. FIG. 7(*b*) illustrates the case where the lower gear coupling pieces 695 are spaced apart from one another by 60 degrees on the basis of the center of the inlet hole 691 by way of example.

Meanwhile, the chamber 69 receives a guide 693 to which a support body 96 of the flow path switcher 9 is coupled. The guide 693 needs to be located lower than the lower gear coupling pieces 695. FIG. 7(*b*) illustrates the case where the guide 693 is fixed to the inner circumference of the inlet hole 691 by way of example.

The guide 693 may be disposed side by side with the third partition 654 and the fourth partition 655. This serves to allow wash water introduced into the chamber 69 to be easily distributed to the second communication holes 657 and the third communication holes 658. The guide 693 may have a wedge shaped cross section such that the width thereof is gradually reduced toward an entrance of the inlet hole 691. This serves to prevent the guide 693 from blocking the flow of wash water into the chamber 69.

The flow path switcher 9 is received in the chamber 69 and serves to sequentially open the first communication hole 656, the second communication holes 657 and the third communication holes 658 according to a pressure (water pressure) inside the chamber 69.

The flow path switcher 9 may include a support member configured to reciprocate within the chamber 69 according to a water pressure inside the chamber 69 and a switcher member rotatably coupled to the support member and located above the support member. That is, the switcher member may include the switcher body 91 rotatably received in the chamber 69, and the support member may include the support body 96 received in the chamber 69 to support the switcher body 91.

Figure 8:
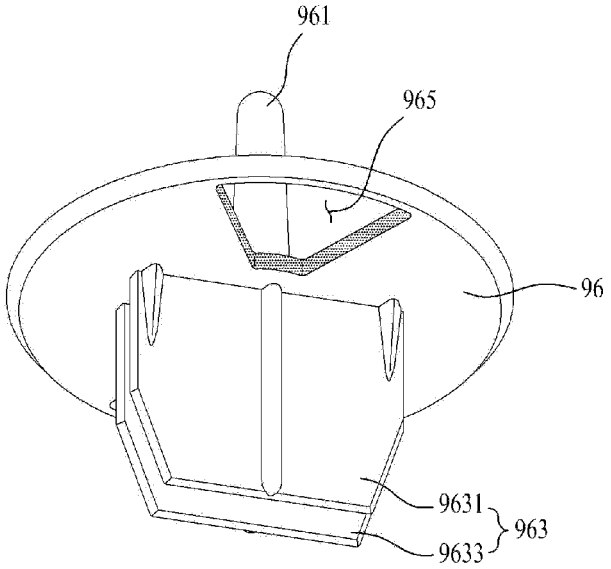
FIGS. 8 and 9 are perspective views illustrating a support body and a switcher body included in a flow path switcher.
Figure 8:
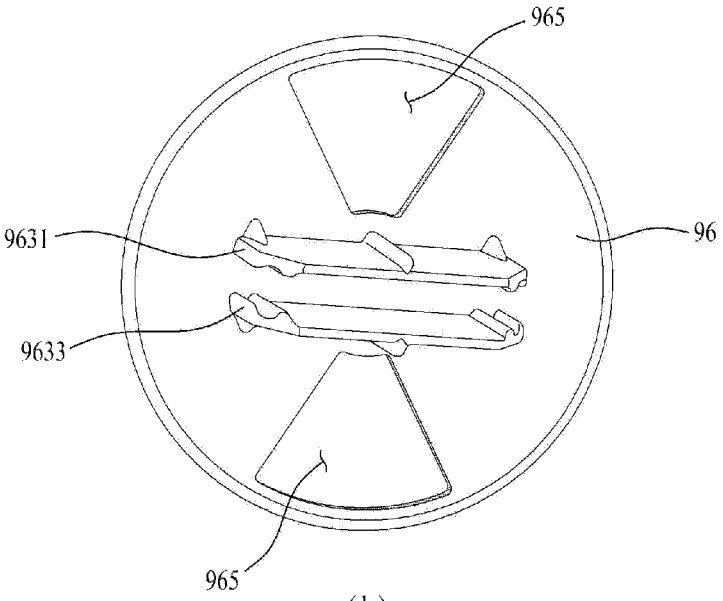

As exemplarily illustrated in FIG. 8, the support body 96 is configured to reciprocate in the height direction of the chamber 69 (from the inlet hole 691 toward the chamber communication hole 651), thereby serving to assist reciprocation of the switcher body 91 and to provide a rotation center for the switcher body 91.

The support body 96 may have a disc shape and include support body through-holes 965 formed through the support body 96, a shaft 961 protruding from the upper surface of the support body 96 toward the switcher body 91, and a guide coupling portion 963 protruding from the lower surface of the support body 96 toward the guide 693 of the chamber 69. There are provided two support body through-holes 965 spaced apart from each other by 180 degrees on the basis of the shaft 961. When the guide coupling portion 963 is coupled with the guide 693, the support body through-holes 965 are located inside a space delimited by the first communication hole 656.

The guide coupling portion 963 may include a first coupling portion 9631 and a second coupling portion 9633 protruding from the lower surface of the support body 96. The first coupling portion 9631 and the second coupling portion 9633 must be spaced apart from each other by a distance required to receive the guide 693. In addition, the first coupling portion 9631 and the second coupling portion 9633 may have a length to prevent unintentional separation thereof from the guide 693 even when the support body 96 is moved upward to the highest height within the chamber 69.

As such, when wash water is introduced into the chamber 69, the support body 96 is moved upward in the height direction of the chamber 69 under guidance of the guide 693 and the guide coupling portion 963. When no wash water is supplied to the chamber 69, the support body 96 performs only downward movement in the height direction of the chamber 69.

Figure 9:
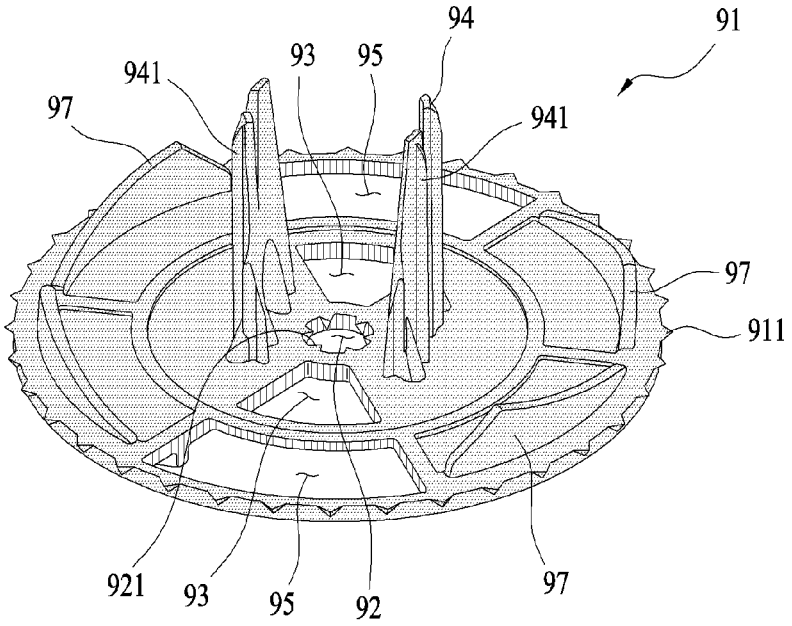
Figure 9:
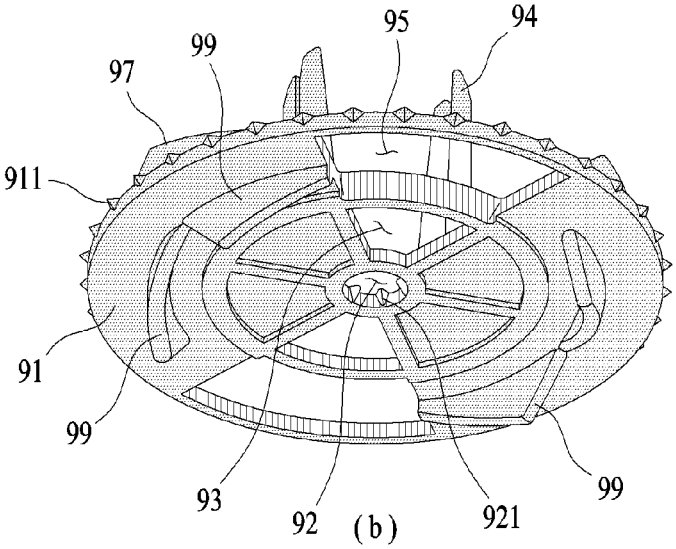

As exemplarily illustrated in FIG. 9, the switcher body 91 may have a disc shape and be configured to reciprocate between the inlet hole 691 of the chamber 69 and the chamber communication hole 651 according to a water pressure inside the chamber 69. That is, the switcher body 91 is moved from the inlet hole 691 toward the chamber communication hole 651 when the water pressure inside the chamber 69 is high (when wash water is supplied to the chamber 69) and moved from the chamber communication hole 651 toward the inlet hole 691 when the water pressure inside the chamber 69 is low (when wash water is supplied to the chamber 69). The separable coupler flange 513 formed at the tower separable coupler 5 is seated on the upper surface of the switcher body 91.

The switcher body 91 is provided at the outer circumferential surface thereof with body bosses 911. The body bosses 911 serve not only to minimize a contact area between the outer circumferential surface of the switcher body 91 and the inner circumferential surface of the chamber 69, but also to prevent impurities from jamming in a space between the outer circumferential surface of the switcher body 91 and the inner circumferential surface of the chamber 69. Differently from the illustration of the drawing, the body bosses 911 may be formed at the inner circumferential surface of the chamber 69 to extend in the height direction of the chamber 69.

The switcher body 91 includes a shaft penetration hole 92 for penetration of the shaft 961 of the support body 96, first openings 93 and second openings 95 perforated in the switcher body 91, and gears 97 and 99 to cause the switcher body 91 to be rotated only in any one direction of the clockwise direction and the counterclockwise direction by being engaged respectively with the upper gear coupling pieces 6523, 6524, 6525, 6533, 6534, and 6535 and the lower gear coupling pieces 695.

The shaft 961 of the support body 96 inserted into the shaft penetration hole 92 forms the rotation center of the switcher body 91. The shaft penetration hole 92 may be provide with a plurality of penetration hole bosses 921 in order to minimize a contact area between the inner circumference of the shaft penetration hole 92 and the outer circumferential surface of the shaft 961.

The penetration hole bosses 921 may protrude from the circumference of the shaft penetration hole 92 to the center of the shaft penetration hole 92. Alternatively, the penetration hole bosses 921 may protrude from the outer circumferential surface of the shaft 961 to extend in the height direction of the shaft 961.

When the penetration hole bosses 921 are formed at the shaft penetration hole 92, this may allow the switcher body 91 to be easily rotated about the shaft 961 and to minimize jamming of impurities in a space between the shaft penetration hole 92 and the shaft 961.

The first openings 93 serve to open the support body through-holes 965 formed in the support body 96 according to the rotation angle of the switcher body 91. The second openings 95 serve to open any one of the second communication holes 657 and the third communication holes 658 according to the rotation angle of the switcher body 91.

To this end, a distance from the shaft penetration hole 92 to each first opening 93 must be shorter than a distance from the shaft penetration hole 92 to each second opening 95.

Figure 10A:
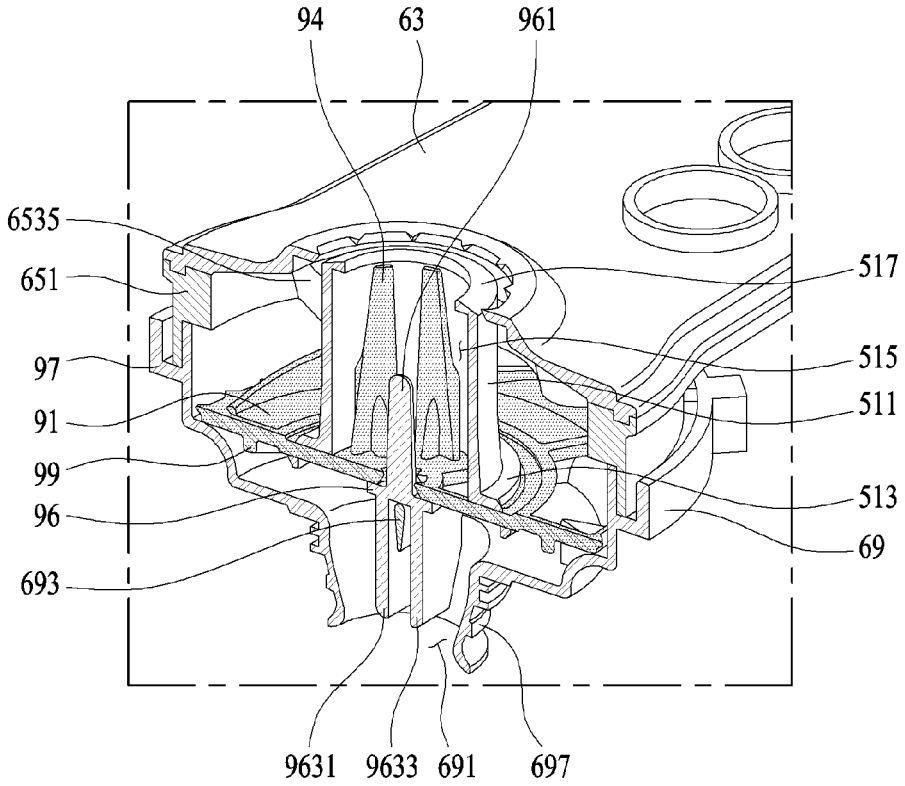
FIGS. 10A and 10B and FIG. 11 are views illustrating an operating process of the flow path switcher.
Figure 10A:
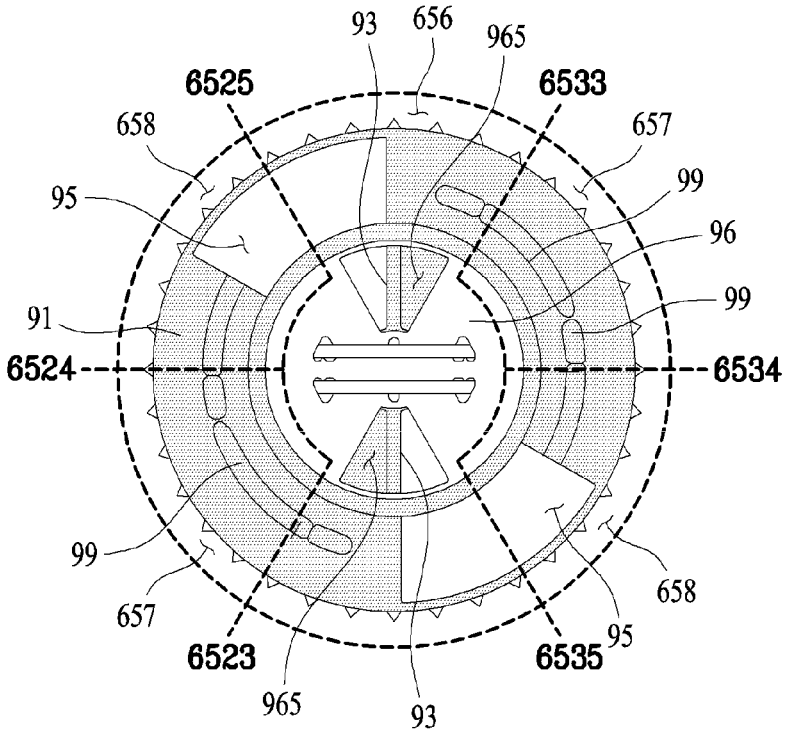
Figure 10B:
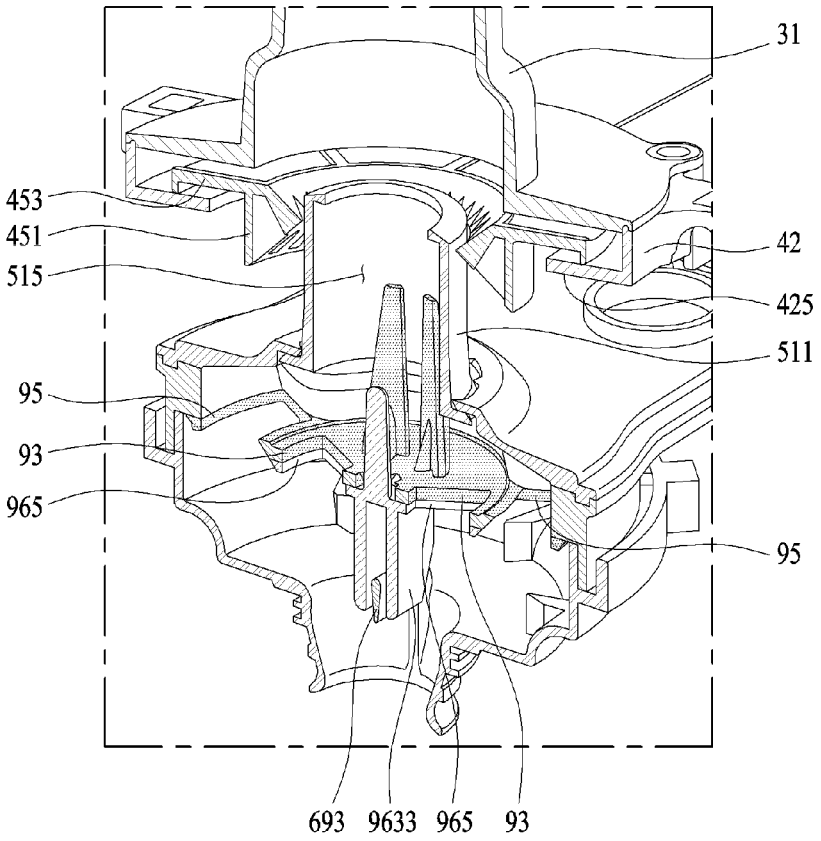
Figure 10B:
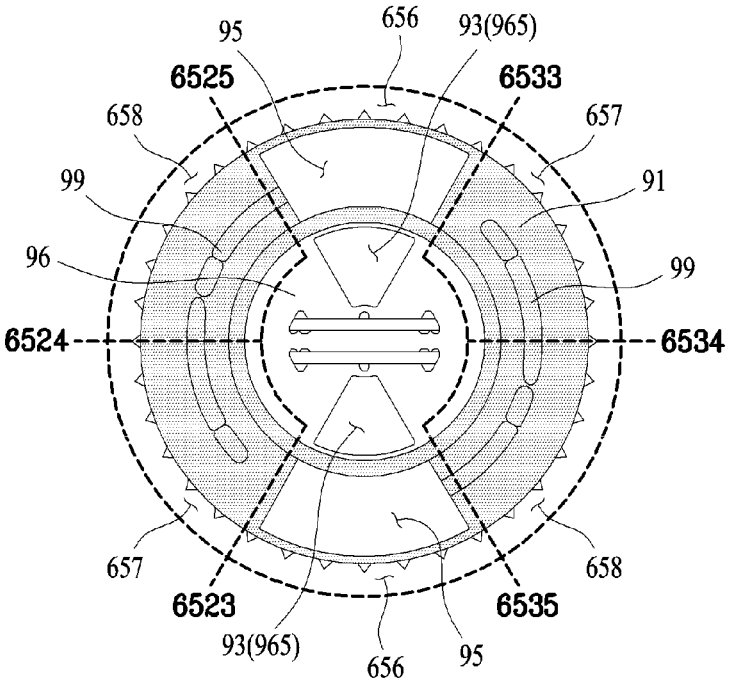

Meanwhile, the second openings 95 may open a space defined by the first rib 6523 and the sixth rib 6535 and a space defined by the third rib 6525 and the fourth rib 6533 respectively in the entire space of the first communication hole 656 when the first openings 93 open the support body through-holes 965 (see FIG. 10B).

To this end, the center of each first opening 93 and the center of each second opening 95 must be located on a straight line passing through the center of the shaft penetration hole 92.

The switcher body 91 may further be provided at the upper surface thereof with separable coupler guides 94. The separable coupler guides 94 are configured to be inserted into the body through-bore 515 of the separable coupler body 511. When the switcher body 91 is moved upward within the chamber 69, the separable coupler guides 94 apply pressure to the guide support portion 517, thereby causing the separable coupler body 511 to be retracted from the lower arm 6 through the first discharge hole 631.

The separable coupler body 511 retracted from the lower arm 6 must be separated from the separable coupler guides 94 to thereby be connected to the tower support unit 4. Thus, to facilitate easy separation of the separable coupler body 511 from the separable coupler guides 94, the separable coupler guides 94 may be formed with guide protrusions 941.

The guide protrusions 941 serve to minimize a contact area between the body through-bore 515 and the separable coupler guides 94. Thus, the guide protrusions 941 may extend in the height direction of the separable coupler guides 94. Note that the guide protrusions 941 may protrude from the inner circumference of the body through-bore 515 so as to come into contact with the separable coupler guides 94.

The gears 97 and 99 may include the upper gears 97 that are formed at the upper surface of the switcher body 91 so as to be engaged with the upper gear coupling pieces 6523, 6524, 6525, 6533, 6534 and 6535 and the lower gears 99 that are formed at the lower surface of the switcher body 91 so as to be engaged with the lower gear coupling pieces 695.

The upper gears 97 serve to rotate the switcher body 91 in a clockwise direction (or in a counterclockwise direction) by a predetermined angle (e.g., 30 degrees) by being engaged with the upper gear coupling pieces 6523, 6524, 6525, 6533, 6534 and 6535. The lower gears 99 serve to rotate the switcher body 91 in the clockwise direction (or in the counterclockwise direction) by a predetermined angle (e.g., 30 degrees) by being engaged with the lower gear coupling pieces 695.

The lower gears 99 and the lower gear coupling pieces 695 must be configured to cause the switcher body 91 to be rotated in the same direction as the rotation direction of the switcher body 91 when the upper gears 97 and the upper gear coupling pieces 6523, 6524, 6525, 6533, 6534 and 6535 are engaged with each other.

Hereinafter, an operating process of the lower arm 6 will be described with reference to FIGS. 10A and 10B and FIG. 11.

As exemplarily illustrated in FIG. 10A, when wash water is not supplied to the chamber 69, the support body 96 remains seated on the guide 693 and the lower gears 99 of the switcher body 91 remain engaged with the lower gear coupling pieces 695.

At this time, the support body through-hole 965 is located below a space defined by the first flange 6521 and the second flange 6531 in the entire space of the first communication hole 656, the center of each first opening 93 is spaced apart from the center of the support body through-hole 965 by 30 degrees (such that half of the support body through-hole 965 is opened by the first opening 93), and each second opening 95 is located between the first communication hole 656 and a corresponding one of the third communication holes 658.

When the first supply flow path 21 is opened via the supply flow path switching valve 27 and power is supplied to the motor 187 to operate the water supply pump 18, wash water is supplied to the chamber 69.

When a water pressure inside the chamber 69 increases as the wash water is supplied to the chamber 69, the support body 96 is moved from the inlet hole 691 toward the chamber communication hole 651 and, consequently, the switcher body 91 is also moved toward the chamber communication hole 651.

Although the support body 96 is moved upward without rotation within the chamber 69 because the guide coupling portions 9631 and 9633 are coupled with the guide 693, the switcher body 91 is rotated in the clockwise direction by 30 degrees on the basis of the shaft 961 when the upper gears 97 are engaged with the upper gear coupling pieces 6523, 6524, 6525, 6533, 6534 and 6535.

Meanwhile, the separable coupler body 511 located above the switcher body 91 is retracted from the inside of the lower arm 6 toward the flow path tower 3 by the separable coupler guides 94 (used to push the guide support portion 517), thereby being inserted into the receiving hole 455 of the connector 45.

There is no risk of the separable coupler body 511 being separated from the lower arm 6 because the diameter of the separable coupler flange 513 is larger than the diameter of the first discharge hole 631 formed in the upper frame 63.

When the switcher body 91 is rotated in the clockwise direction by 30 degrees, as exemplarily illustrated in FIG. 10B, the first openings 93 completely open the support body through-holes 965 and the second openings 95 are located inside a space defined by the first partition 652 and the second partition 653 (more specifically, one second opening 95 is located in a space between the first rib 6523 and the sixth rib 6535 and the other second opening 95 is located in a space between the third rib 6525 and the fourth rib 6533).

As such, the second communication holes 657 in communication with the second flow path F2 and the third communication holes 658 in communication with the third flow path F3 remain closed by the switcher body 91.

Meanwhile, when the first openings 93 and the second openings 95 are located inside the first communication hole 656 (FIG. 10B), wash water introduced into the chamber 69 is supplied only to the flow path tower 3 through the separable coupler body 511. Thereby, the flow path tower 3 will eject the wash water toward the lower rack 193.

Thereafter, when supply of power to the motor 187 of the water supply pump 18 stops, the water pressure inside the chamber 69 is lowered, which causes the support body 96 and the switcher body 91 to be moved toward the inlet hole 691 located at the bottom of the chamber 69.

The support body 96 is moved toward the inlet hole 691 without rotation owing to the guide 693 and the guide coupling portion 963, whereas the switcher body 91 is rotated in the clockwise direction by 30 degrees when the lower gears 99 and the lower gear coupling pieces 695 are engaged with each other.

Figure 11:
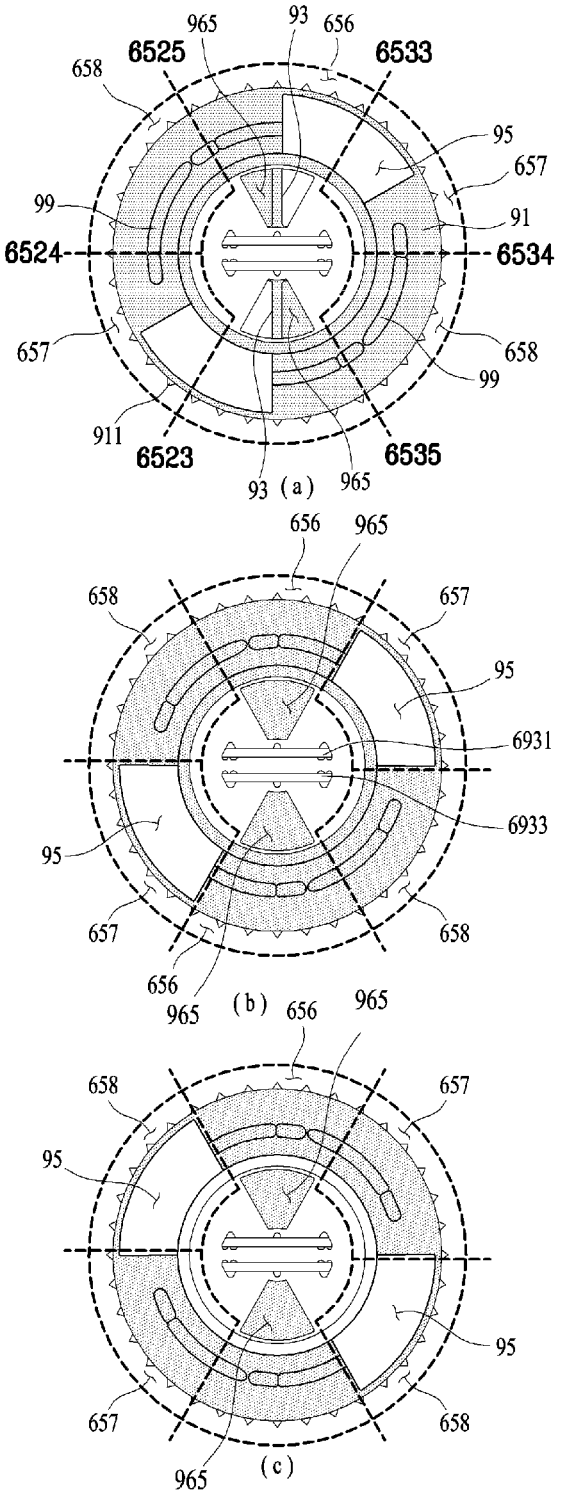

That is, as exemplarily illustrated in FIG. 11(*a*), each first opening 93 of the switcher body 91 is spaced apart from the support body through-hole 965 by 30 degrees and each second opening 95 is located between the first communication hole 656 and the second communication hole 657.

The separable coupler body 511 will be separated from the connector 56 and moved toward the lower arm 6 because the switcher body 91 is moved toward the inlet hole 691.

Thereafter, when power is again supplied to the motor 187 of the water supply pump 18, the support body 96 and the switcher body 91 are again moved from the inlet hole 691 toward the chamber communication hole 651 by the water pressure inside the chamber 69.

When wash water is again supplied to the chamber 69, as exemplarily illustrated in FIG. 11(*b*), the switcher body 91 is rotated in the clockwise direction by 30 degrees. Thereby, the support body through-hole 965 of the support body 96 is closed by the switcher body 91 and the second openings 95 open the second communication holes 657 that are in communication with the second flow path F2.

When the second communication holes 657 are opened, the wash water inside the chamber 69 is supplied to the second flow path F2 and, in turn, the wash water inside the second flow path F2 is ejected to the lower rack 193 through the second discharge holes 633.

However, the support body through-hole 965 and the third communication holes 658 remain closed by the switcher body 91 and, therefore, no wash water is supplied to the flow path tower 3 and the third flow path F3.

Thereafter, when supply of power to the motor 187 of the water supply pump 18 stops, the water pressure inside the chamber 69 is lowered, which causes the support body 96 and the switcher body 91 to be moved toward the inlet hole 691 located at the bottom of the chamber 69.

The support body 96 is moved toward the inlet hole 691 without rotation owing to the guide 693 and the guide coupling portion 963, whereas the switcher body 91 is rotated in the clockwise direction by 30 degrees when the lower gears 99 and the lower gear coupling pieces 695 are engaged with each other.

At this time, the support body through-hole 965 will remain closed by the switcher body 91 and each second opening 95 of the switcher body 91 will be located between the second communication hole 657 and the third communication hole 658.

When wash water is again supplied to the chamber 69, the support body 96 and the switcher body 91 are moved from the inlet hole 691 toward the chamber communication hole 651 to reach a state as exemplarily illustrated in FIG. 11(*c*).

That is, since the switcher body 91 is rotated in the clockwise direction by 30 degrees, the third communication holes 658 that are in communication with the third flow path F3 are opened by the second openings 95, whereas the support body through-hole 965 and the second communication holes 657 remain closed by the switcher body 91.

As the third communication holes 658 are opened, the wash water inside the chamber 69 is ejected to the lower rack 193 through the third flow path F3 and the third discharge holes 635. However, the wash water is not supplied to the flow path tower 3 and the second flow path F2 because the support body through-hole 965 and the second communication holes 657 remain closed by the switcher body 91.

Thereafter, when supply of power to the motor 187 of the water supply pump 18 stops, the support body 96 and the switcher body 91 are moved toward the inlet hole 691 located at the bottom of the chamber 69 to reach a state as exemplarily illustrated in FIG. 10A.

Although the above-described embodiment illustrates the case where the flow path switcher 9 is rotated only in the clockwise direction, the upper gears 97, the lower gears 99, the upper gear coupling pieces 6523, 6524, 6525, 6533, 6534 and 6535 and the lower gear coupling pieces 695 may be configured to cause counterclockwise rotation of the flow path switcher 9.

As is apparent from the above description, the present disclosure may provide a dishwasher having improved washing ability.

In addition, the present disclosure may provide a dishwasher in which a plurality of wash water flow paths is formed in a single ejection arm for ejection of wash water.

In addition, the present disclosure may provide a dishwasher having a flow path switcher to selectively open a plurality of flow paths formed in a single ejection arm.

In accordance with an aspect of the present disclosure, a dishwasher includes a tub configured to provide a wash space, a first rack located inside the tub to receive a washing object therein and a second rack located below the first rack, a flow path tower provided at the second rack and configured to eject wash water to the first rack, an ejection arm including a chamber for introduction of wash water, a first flow path in communication with the chamber, and a second flow path and a third flow path in communication with the chamber to eject wash water to the second rack, the second flow path and the third flow path being separated from each other, a tower separable coupler provided inside the ejection arm, the tower separable coupler connecting the first flow path and the flow path tower to each other when wash water is supplied to the first flow path, and a flow path switcher provided inside the chamber, the flow path switcher selectively opening the first flow path, the second flow path and the third flow path according to a water pressure inside the chamber.

The flow path switcher may include a support body configured to reciprocate within the chamber according to the pressure inside the chamber, a support body through-hole formed through the support body so as to be in communication with the first flow path, a switcher body rotatably coupled to the support body, the switcher body being located above the support body, a first opening configured to open or close the support body through-hole according to a rotation angle of the switcher body, and a second opening configured to open or close any one of the second flow path and the third flow path according to the rotation angle of the switcher body.

The dishwasher may further include a body boss configured to protrude from an outer circumferential surface of the switcher body so as to come into contact with an inner circumferential surface of the chamber.

The dishwasher may further include an upper gear coupling piece located above the switcher body, the upper gear coupling piece being formed by a partition configured to separate the first flow path, the second flow path and the third flow path from one another, a lower gear coupling piece formed in the chamber and located below the switcher body, an upper gear formed at an upper surface of the switcher body, the upper gear being engaged with the upper gear coupling piece to rotate the switcher body, and a lower gear formed at a lower surface of the switcher body, the lower gear being engaged with the lower gear coupling piece to rotate the switcher body in the same direction as a rotation direction of the switcher body when the upper gear and the upper gear coupling piece are engaged with each other.

The flow path switcher may further include a shaft configured to protrude from the support body toward the switcher body, a shaft penetration hole formed in the switcher body to receive the shaft therein, and a penetration hole boss configured to protrude from a circumference of the shaft penetration hole toward the center of the shaft penetration hole.

The chamber may include a support pipe configured to rotatably connect the ejection arm to the tub, an inlet hole formed through the support pipe to permit introduction of wash water into the chamber, and a guide configured to prevent rotation of the support body and to guide reciprocation of the support body within the chamber.

The support body may include a first coupling portion and a second coupling portion spaced apart from each other by a predetermined distance to allow the guide to be received therebetween, and the guide may be located inside the inlet hole to extend in a diametric direction of the inlet hole.

The ejection arm may include a lower frame having a first communication hole configured to communicate the first flow path and the chamber with each other, a second communication hole configured to communicate the second flow path and the chamber with each other, and a third communication hole configured to communicate the third flow path and the chamber with each other, and an upper frame having a first discharge hole located above the first communication hole to provide a space for movement of the tower separable coupler toward the flow path tower, a second discharge hole for discharge of wash water, introduced into the second flow path, to the second rack, and a third discharge hole for discharge of wash water, introduced into the third flow path, to the second rack.

The first discharge hole may have a discharge hole boss configured to protrude toward the center of the first discharge hole so as to support an outer circumferential surface of the tower separable coupler.

The tower separable coupler may include a separable coupler body configured to be movable from the upper frame through the first discharge hole, a body through-bore formed through the separable coupler body, a separable coupler flange configured to protrude from an outer circumferential surface of the separable coupler body and supported by the switcher body, and a flange boss configured to protrude from an outer circumferential surface of the separable coupler flange, and the upper frame may further have a flange receiving portion configured to provide a space for reception of the separable coupler flange, the flange receiving portion coming into contact with the flange boss.

The tower separable coupler may further include a guide support portion formed at an inner circumferential surface of the body through-bore so as to have a smaller diameter than a diameter of the body through-bore, and the flow path switcher may further include a separable coupler guide configured to protrude from the switcher body so as to be inserted into the body through-bore and a guide protrusion configured to protrude from the separable coupler guide so as to come into contact with the inner circumferential surface of the body through-bore.

The dishwasher may further include a fixing body provided at the second rack, the flow path tower being fixed to the fixing body, a fixing body through-hole formed through the fixing body, a connector body configured to be inserted into the fixing body through-hole, the connector body being movable in a diametric direction of the fixing body through-hole, and a receiving hole formed through the connector body so as to be in communication with the flow path tower, the tower separable coupler being inserted into the receiving hole.

The dishwasher may further include a receiving hole boss configured to protrude from the receiving hole toward the center of the receiving hole, the receiving hole boss supporting an outer circumferential surface of the tower separable coupler when the tower separable coupler is received in the receiving hole.

The receiving hole boss may include a plurality of receiving hole bosses formed at a circumference of the receiving hole so as to be spaced apart from one another by a predetermined distance.

The dishwasher may further include an upper slope formed at an upper surface of the connector body so as to be inclined toward the receiving hole, and a slope ridge configured to protrude from the upper slope, the slope ridge guiding wash water to a space defined between a respective one of the receiving hole bosses and a neighboring one of the receiving hole bosses.

The dishwasher may further include a lower slope formed at a lower surface of the connector body so as to be inclined toward the receiving hole, the lower slope guiding the tower separable coupler to the receiving hole.

The second opening may be configured to open the first flow path when the first opening opens the support body through-hole.

The ejection arm may include a chamber communication hole in communication with the chamber, a first rib, a second rib, a third rib, a fourth rib, a fifth rib, and a sixth rib configured to protrude from a circumference of the chamber communication hole toward the center of the chamber communication hole, the first rib to the sixth rib being spaced apart from one another by 60 degrees on the basis of the center of the chamber communication hole, a first flange fixed in the chamber communication hole via the first rib and the third rib, and a second flange fixed in the chamber communication hole via the fourth rib and the sixth rib, the first flange and the second flange defining a passage for movement of the tower separable coupler, the first flow path may be in communication with the chamber through a first communication hole, the first communication hole being defined by the first rib, the first flange, the third rib, the fourth rib, the second flange, and the sixth rib, and the second flow path and the third flow path may be respectively in communication with the chamber through a second communication hole and a third communication hole, the second communication hole and the third communication hole being separated from each other via the second rib and the fifth rib.

The center of the first opening and the center of the second opening may be located on a straight line passing through a rotation center of the switcher body, and the second opening may be located in a space defined between the first rib and the sixth rib and a space defined between the third rib and the fourth rib when the first opening opens the support body through-hole.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher comprising:

a tub configured to provide a wash space;

a first rack located inside the tub to receive at least one object to be washed;

an ejection arm including a chamber for introduction of wash water, a first flow path in communication with the chamber, and a second flow path and a third flow path in communication with the chamber to eject wash water to the first rack, the second flow path and the third flow path being separated from each other;

a flow path tower fixed to the first rack to prevent a position variation with respect to the first rack and configured to communicate with the first flow path, and separated from the ejection arm;

a flow path switcher provided inside the chamber, the flow path switcher selectively opening the first flow path, the second flow path and the third flow path according to a water pressure inside the chamber, and a tower separable coupler provided at the ejection arm, the tower separable coupler configured to selectively connect the ejection arm and the flow path tower, wherein the chamber is fixed to the bottom of the tub to prevent the ejection arm from moving upward or downward with respect to the first rack, wherein the flow path switcher selectively opens and closes one of the first flow path, the second flow path and the third flow path while ascending and descending, wherein the tower separable coupler is mounted on the flow path switcher, and wherein the tower separable coupler is configured to be raised from the ejection arm to connect the first flow path and the flow path tower when the flow path switcher opens the first flow path.

2. The dishwasher according to claim 1, wherein the flow path switcher includes:

a support body configured to reciprocate within the chamber according to the pressure inside the chamber;

a support body through-hole formed through the support body so as to be in communication with the first flow path;

a switcher body rotatably coupled to the support body, the switcher body being located above the support body;

a first opening configured to open or close the support body through-hole according to a rotation angle of the switcher body; and a second opening configured to open or close any one of the second flow path and the third flow path according to the rotation angle of the switcher body.

3. The dishwasher according to claim 2, further comprising a body boss configured to protrude from an outer circumferential surface of the switcher body so as to come into contact with an inner circumferential surface of the chamber.

4. The dishwasher according to claim 2, further comprising:

an upper gear coupling piece located above the switcher body, the upper gear coupling piece being formed by a partition configured to separate the first flow path, the second flow path and the third flow path from one another;

a lower gear coupling piece formed in the chamber and located below the switcher body;

an upper gear formed at an upper surface of the switcher body, the upper gear being engaged with the upper gear coupling piece to rotate the switcher body; and a lower gear formed at a lower surface of the switcher body, the lower gear being engaged with the lower gear coupling piece to rotate the switcher body in the same direction as a rotation direction of the switcher body when the upper gear and the upper gear coupling piece are engaged with each other.

5. The dishwasher according to claim 4, wherein the flow path switcher further includes:

a shaft configured to protrude from the support body toward the switcher body;

a shaft penetration hole formed in the switcher body to receive the shaft therein; and a penetration hole boss configured to protrude from a circumference of the shaft penetration hole toward the center of the shaft penetration hole.

6. The dishwasher according to claim 5, wherein the chamber includes:

a support pipe configured to rotatably connect the ejection arm to the tub;

an inlet hole formed through the support pipe to permit introduction of wash water into the chamber; and a guide configured to prevent rotation of the support body and to guide reciprocation of the support body within the chamber.

7. The dishwasher according to claim 6, wherein the support body includes a first coupling portion and a second coupling portion spaced apart from each other by a predetermined distance to allow the guide to be received therebetween, and wherein the guide is located inside the inlet hole to extend in a diametric direction of the inlet hole.

8. The dishwasher according to claim 2, wherein the ejection arm includes:

a lower frame having a first communication hole configured to communicate the first flow path and the chamber with each other, a second communication hole configured to communicate the second flow path and the chamber with each other, and a third communication hole configured to communicate the third flow path and the chamber with each other; and an upper frame having a first discharge hole located above the first communication hole to provide a space for movement of the tower separable coupler toward the flow path tower, a second discharge hole for discharge of wash water, introduced into the second flow path, to the second rack, and a third discharge hole for discharge of wash water, introduced into the third flow path, to the second rack.

9. The dishwasher according to claim 8, wherein the first discharge hole has a discharge hole boss configured to protrude toward the center of the first discharge hole so as to support an outer circumferential surface of the tower separable coupler.

10. The dishwasher according to claim 8, wherein the tower separable coupler includes:

a separable coupler body configured to be movable from the upper frame through the first discharge hole;

a body through-bore formed through the separable coupler body;

a separable coupler flange configured to protrude from an outer circumferential surface of the separable coupler body and supported by the switcher body; and a flange boss configured to protrude from an outer circumferential surface of the separable coupler flange, and wherein the upper frame further has a flange receiving portion configured to provide a space for reception of the separable coupler flange, the flange receiving portion coming into contact with the flange boss.

11. The dishwasher according to claim 10, wherein the tower separable coupler further includes a guide support portion formed at an inner circumferential surface of the body through-bore so as to have a smaller diameter than a diameter of the body through-bore, and wherein the flow path switcher further includes:

a separable coupler guide configured to protrude from the switcher body so as to be inserted into the body through-bore; and a guide protrusion configured to protrude from the separable coupler guide so as to come into contact with the inner circumferential surface of the body through-bore.

12. The dishwasher according to claim 2, further comprising:

a fixing body provided at the first rack, the flow path tower being fixed to the fixing body;

a fixing body through-hole formed through the fixing body;

a connector body configured to be inserted into the fixing body through-hole, the connector body being movable in a diametric direction of the fixing body through-hole; and a receiving hole formed through the connector body so as to be in communication with the flow path tower, the tower separable coupler being inserted into the receiving hole.

13. The dishwasher according to claim 12, further comprising a receiving hole boss configured to protrude from the receiving hole toward the center of the receiving hole, the receiving hole boss supporting an outer circumferential surface of the tower separable coupler when the tower separable coupler is received in the receiving hole.

14. The dishwasher according to claim 13, wherein the receiving hole boss includes a plurality of receiving hole bosses formed at a circumference of the receiving hole so as to be spaced apart from one another by a predetermined distance.

15. The dishwasher according to claim 14, further comprising:

an upper slope formed at an upper surface of the connector body so as to be inclined toward the receiving hole; and a slope ridge configured to protrude from the upper slope, the slope ridge guiding wash water to a space defined between a respective one of the receiving hole bosses and a neighboring one of the receiving hole bosses.

16. The dishwasher according to claim 14, further comprising a lower slope formed at a lower surface of the connector body so as to be inclined toward the receiving hole, the lower slope guiding the tower separable coupler to the receiving hole.

17. The dishwasher according to claim 2, wherein the second opening is configured to open the first flow path when the first opening opens the support body through-hole.

18. The dishwasher according to claim 17, wherein the ejection arm includes:

a chamber communication hole in communication with the chamber;

a first rib, a second rib, a third rib, a fourth rib, a fifth rib, and a sixth rib configured to protrude from a circumference of the chamber communication hole toward the center of the chamber communication hole, the first rib to the sixth rib being spaced apart from one another by 60 degrees on the basis of the center of the chamber communication hole;

a first flange fixed in the chamber communication hole via the first rib and the third rib; and a second flange fixed in the chamber communication hole via the fourth rib and the sixth rib, the first flange and the second flange defining a passage for movement of the tower separable coupler, wherein the first flow path is in communication with the chamber through a first communication hole, the first communication hole being defined by the first rib, the first flange, the third rib, the fourth rib, the second flange, and the sixth rib, and wherein the second flow path and the third flow path are respectively in communication with the chamber through a second communication hole and a third communication hole, the second communication hole and the third communication hole being separated from each other via the second rib and the fifth rib.

19. The dishwasher according to claim 18, wherein the center of the first opening and the center of the second opening are located on a straight line passing through a rotation center of the switcher body, and wherein the second opening is located in a space defined between the first rib and the sixth rib and a space defined between the third rib and the fourth rib when the first opening opens the support body through-hole.

* * * * *